US006431838B2

(12) United States Patent
Tanaka et al.

(10) Patent No.: US 6,431,838 B2
(45) **Date of Patent: *Aug. 13, 2002**

(54) DRIVE UNIT FOR DRIVING FUEL PUMP FOR SMALL SIZED VEHICLE

(75) Inventors: Hiroshi Tanaka; Takeshi Konno, both of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/837,172

(22) Filed: Apr. 19, 2001

Related U.S. Application Data

(63) Continuation of application No. 09/082,118, filed on May 20, 1998.

(30) Foreign Application Priority Data

May 20, 1997 (JP) ..... 9-129450

(51) Int. Cl.[7] ..... F04B 49/00

(52) U.S. Cl. ..... 417/43; 123/463; 123/514; 123/456

(58) Field of Search ..... 417/43; 123/463, 123/514, 456

(56) References Cited

U.S. PATENT DOCUMENTS 4,554,634 A 11/1985 Shinoda
4,920,942 A 5/1990 Fujimori et al.
5,355,859 A 10/1994 Weber
5,379,741 A 1/1995 Matysiewicz et al.
5,507,266 A 4/1996 Wright et al.
5,555,872 A 9/1996 Takeuchi et al.
5,572,974 A 11/1996 Wakeman
5,608,623 A 3/1997 White
5,715,797 A 2/1998 Minagawa et al.
5,762,046 A 6/1998 Holmes et al.
5,842,454 A 12/1998 Miwa et al.
5,937,829 A 8/1999 Endou
6,016,791 A 1/2000 Thomas et al.
6,240,902 B1 * 6/2001 Tanaka et al. ..... 123/463

FOREIGN PATENT DOCUMENTS

DE 4443879 A1 6/1996
EP 0055417 A2 7/1982

* cited by examiner

*Primary Examiner*—William C. Doerrler
*Assistant Examiner*—Mark Shulman
(74) *Attorney, Agent, or Firm*—Birch, Stewart, Kolasch & Birch

(57) ABSTRACT

A drive unit for driving a fuel pump for a small-sized vehicle, which is capable of reducing the current consumption of the fuel pump. A drive unit includes an ECU for controlling the fuel injection amount of a fuel injector. The ECU drives the fuel pump on the basis of control data for controlling the fuel injection amount of the fuel injector and of a power supply voltage of the fuel pump. For example, the fuel pump is driven under pulse-width modulation (PWM) in such manner that a pulse-width of a PWM signal is made larger with an increase in the injection amount of the fuel injector and is made smaller with a decrease in the fuel injection amount of the fuel injector.

3 Claims, 4 Drawing Sheets

DRIVE UNIT FOR DRIVING FUEL PUMP FOR SMALL SIZED VEHICLE

This application is a continuation of co-pending Application No. 09/082,118, filed on May 20, 1998, the entire contents of which are hereby incorporated by reference and for which priority is claimed under 35 U.S.C. § 120; and this application claims priority of Application No. 9-129450 filed in Japan on May 20, 1997 under 35 U.S.C. § 119.

BACKGROUND OF THE INVENTION

1. Field of the Invention

The present invention relates to a drive unit for driving a fuel pump for a small-sized vehicle using an electronic control unit (ECU).

2. Description of Background Art

A conceptual view of a drive unit for driving a fuel pump for a motorcycle is shown in FIG. 6. Referring to FIG. 6, gasoline is fed from a fuel tank 2 into a fuel pump 4 through a filter 3. The gasoline is pressurized in the fuel pump 4, and is fed into a fuel injector 6 through a filter 5.

The fuel pressure in an intake manifold 7 is maintained constant by a pressure regulator 8, and gasoline is fed into the fuel tank 2 through the pressure regulator 8, thus gasoline can circulate back to the fuel tank 2. A piston 21 is reciprocated along with the combustion of gasoline, to rotate a crank (not shown).

A power supply voltage is supplied from an on-vehicle battery 10 to the fuel pump 4. The fuel injection amount of the fuel injector 6 is controlled by an ECU (Electronic Control Unit) 9.

In the related art for motorcycles, the fuel pump 4 is driven such that a flow rate of gasoline passing through the fuel pump 4 is maximized irrespective of the fuel injection amount of the fuel injector 6.

In the case where a total current consumption of an electric system is large as in a four-wheeled vehicle, a ratio of the current consumption of the fuel pump to the total current consumption of the electric system becomes small.

Meanwhile, in the case where a total current consumption of an electric system is small, as in a motorcycle, a ratio of the current consumption of the fuel pump to the total current consumption of the electric system becomes large.

For this reason, it is expected to develop a drive unit for driving a fuel pump for a motorcycle, which is capable of reducing the current consumption of the fuel pump.

Further, it is expected to develop a drive unit for driving the fuel pump for a motorcycle, which prevents an injection amount of a fuel injector from being varied depending on a change in the power supply voltage of the fuel pump.

SUMMARY AND OBJECTS OF THE INVENTION

According to the present invention, a drive unit for driving a fuel pump for a small-sized vehicle is provided wherein an electronic control unit drives the fuel pump on the basis of control data for controlling the fuel injection amount of the fuel injector and of the power supply voltage applied to the fuel pump.

Since the drive of the fuel pump is controlled on the basis of control data of the injection amount of the fuel injector and of the power supply voltage of the fuel pump, the drive of the fuel pump can be controlled such that the drive power of the fuel pump is reduced in the case where the fuel injection amount is small.

The drive of the fuel pump can also be controlled such that the fuel injection amount (or injection pressure) is prevented from becoming deficient depending on a change in power supply voltage of the fuel pump.

According to the present invention, a drive unit for driving a fuel pump for a small-sized vehicle is provided wherein an electronic control unit drives the fuel pump under pulse-width modulation (PWM) using a PWM signal on the basis of control data for controlling a fuel injection amount of the fuel injector and of a power supply voltage applied to said fuel pump in such a manner that a pulse-width of the PWM signal is made larger with an increase in the fuel injection amount of said fuel injector and is made smaller with a decrease in the fuel injection amount of the fuel injector.

Since the drive of the fuel pump is controlled on the basis of the control data of an injection amount of the fuel injector and of a power supply voltage of the fuel pump, the drive of the fuel pump can be controlled such that the drive power of the fuel pump is reduced in the case where the fuel injection amount is small.

The drive of the fuel pump can also be controlled such that the. fuel injection amount (or injection pressure) is prevented from becoming deficient depending on a change in the power supply voltage of the fuel pump.

For example, the drive unit is configured wherein a pulse-width of a PWM signal is made larger with an increase in the fuel injection amount of the fuel injector so that the fuel pump can be driven at the maximum flow rate when the pulse-width is maximized. Further, the pulse-width of the PWM signal is made smaller with a decrease in the fuel injection amount of the fuel injector so that the power consumption of the fuel pump can be reduced when the fuel injection amount is small.

According to the present invention, a drive unit for driving a fuel pump for a small-sized vehicle is provided wherein the electronic control unit drives the fuel pump under pulse-width modulation (PWM) using a PWM signal on the basis of control data for controlling the fuel injection amount of said fuel injector and of the power supply voltage applied to said fuel pump in such a manner that when the power supply voltage of said fuel pump is larger than a rating voltage, a pulse-width of the PWM signal is made smaller than that in the case where the power supply voltage is equal to the rating voltage; and when the power supply voltage of said fuel pump is smaller than the rating voltage, the pulse-width of the PWM signal is made larger than that in the case where the power supply voltage is equal to the rating voltage.

Since the drive of the fuel pump is controlled on the basis of the control data of the injection amount of the fuel injector and of a power supply voltage of the fuel pump, the drive of the fuel pump can be controlled such that the drive power of the fuel pump is reduced in the case where the fuel injection amount is small.

The drive of the fuel pump can also be controlled such that the fuel injection amount (or injection pressure) is prevented from becoming deficient depending on a change in the power supply voltage of the fuel pump.

For example, when the power supply voltage of the fuel pump is larger than a rating voltage, the drive power of the fuel pump can be lowered and thereby the power consumption thereof can be reduced by reducing the pulse width of a PWM signal as compared to the case where the power supply voltage of the fuel pump is equal to the rating voltage.

Similarly, when the power supply voltage of the fuel pump is smaller than the rating voltage, the fuel injection amount (or injection pressure) can be prevented from becoming deficient depending on a change in the power supply voltage of the fuel pump by increasing the pulse-width of the PWM signal as compared to the case where the power supply voltage of the fuel pump is equal to the rating voltage.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Figure 1:
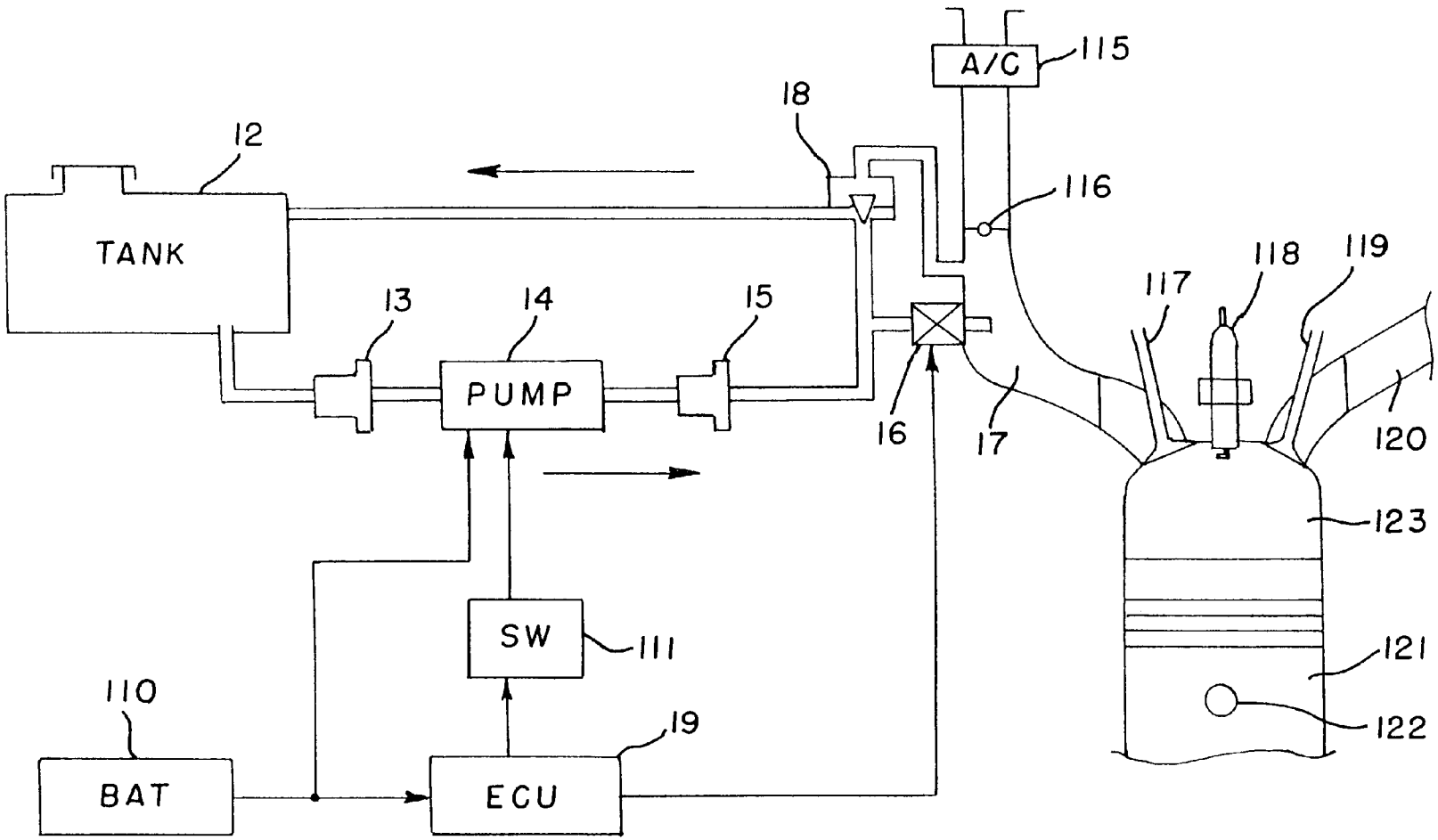
FIG. 1 is a conceptual diagram showing a drive unit for driving a fuel pump of a small-sized vehicle of the present invention.

Hereinafter, an embodiment of the present invention will be described with reference to the accompanying drawings wherein FIG. 1 is a conceptual view of a drive unit for driving a fuel pump for a small-sized vehicle according to the present invention.

The drive unit for driving a fuel pump for a small sized vehicle includes a fuel tank 12, filters 13 and 15, a fuel pump 14, a fuel injector 16, a pressure regulator 18, an on-vehicle battery 110, an ECU 19, and a switching means 111.

Gasoline is fed from the fuel tank 12 into the fuel pump 14 through the filter 13. The gasoline is pressurized in the fuel pump 14, and is fed into the fuel injector 16 through the filter 15.

The fuel pressure in an intake manifold 17 is kept constant by the pressure regulator 18, and gasoline is fed into the fuel tank 12 through the pressure regulator 18, thus gasoline can circulate back to the fuel tank 12. A piston 121 is reciprocated along with combustion of the gasoline, to rotate a crank (not shown).

A power supply voltage is supplied from the on-vehicle battery 110 to the fuel pump 14. The fuel injection amount of the fuel injector 16 is controlled by the ECU 19 which is integrated with a memory in which various control programs are previously stored.

The ECU 19 supplies a PWM (Pulse-Width Modulation) signal into the switching means 111, to drive a motor in the fuel pump 14 under pulse-width modulation through the switching means 111.

The ECU 19 detects a voltage of the on-vehicle battery 110, thus detecting the power supply voltage of the fuel pump 14.

Figure 2:
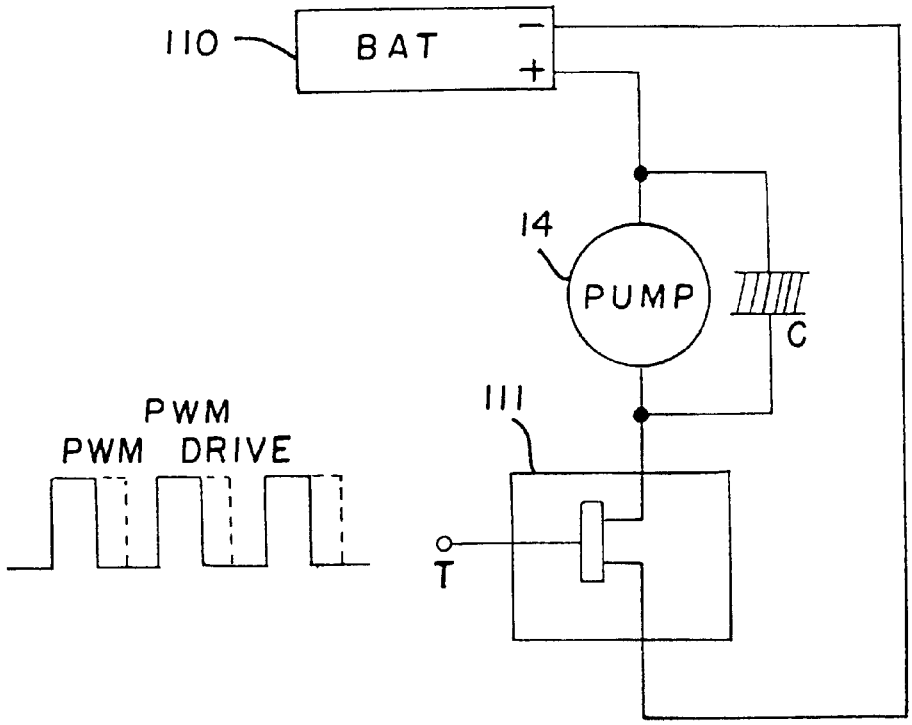
FIG. 2 is a schematic diagram illustrating one method of using the fuel pump shown in FIG. 1.

FIG. 2 is a schematic diagram illustrating a method of driving the fuel pump 14 in the fuel injection system shown in FIG. 1. One terminal of the fuel pump 14 is connected to a high potential side of the on-vehicle battery 110. The other terminal of the fuel pump 14 is connected to an input terminal of the switching means 111. A capacitor C is connected in parallel to the fuel pump 14.

An output terminal of the switching means 111 is connected to a low potential side of the on-vehicle battery 110.

A control terminal T of the switching means 111 is connected to the ECU 19.

The switching means 111 is repeatedly turned on/off on the basis of the PWM signal supplied from the ECU 19, to drive the fuel pump 14 under pulse-width modulation.

As the switching means 111, there may be used a field effect transistor or a bipolar transistor.

The field effect transistor is preferably represented by an n-channel enhancement type field effect transistor.

The bipolar transistor is preferably represented by an npn type transistor.

A pulse-width of the PWM signal supplied from the ECU 19 is determined on the basis of a duty factor D. The duty factor D is calculated in accordance with the following equation:

$$D=A+Ti\times Ne\times K+Pv$$

Here, character A is a minimum duty factor, and Ne is an engine speed (rotational speed, crank rotation speed) factor. Character Ti represents the fuel injection amount. The fuel injector 16 is controlled to inject fuel in the fuel injection amount Ti. Character K is a correction coefficient.

Figure 3:
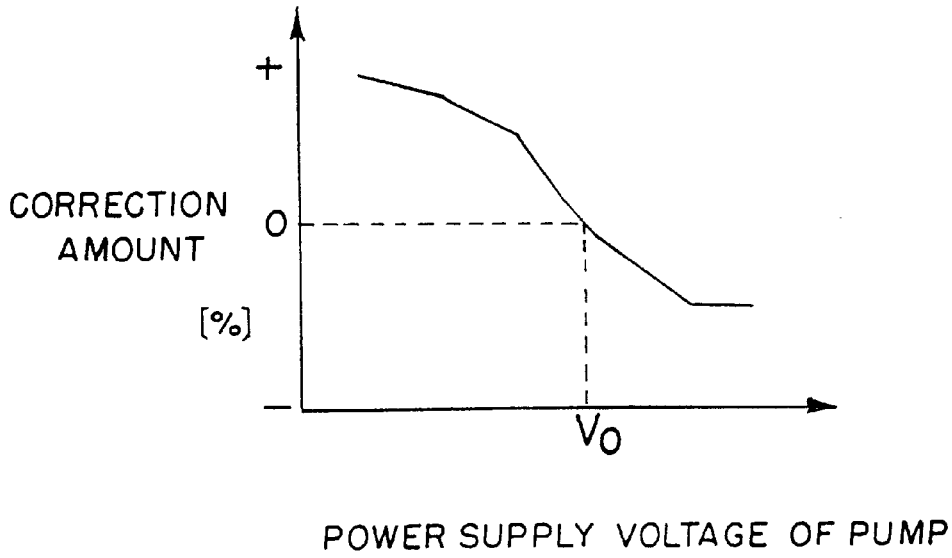
FIG. 3 is a characteristic diagram showing a correction of a duty factor depending on a power supply voltage fuel pump.

Character Pv is a correction amount of the duty factor depending on the power supply voltage of the fuel pump 4 (see FIG. 3).

The ECU 19 calculates the fuel injection amount Ti in accordance with the following equation:

$$Ti=TiM\times Ktw\times Kta\times Kpa\times Kacc$$

Here, character TiM is a basic fuel injection amount. A table (data table) for determining the basic fuel injection amount TiM on the basis of a throttle opening degree and a crank rotational speed is previously stored in the memory integrated with the ECU 19.

Character Ktw is a correction coefficient on the basis of the temperature of the cooling water for cooling a water-cooled engine of a small-sized vehicle. The small-sized vehicle includes a water temperature sensor, an atmospheric temperature sensor, an atmospheric pressure sensor, a throttle opening degree detecting sensor, and a crank rotational speed sensor.

Character Kta is a correction coefficient on the basis of an atmospheric temperature near a throttle inlet port (or throttle valve).

Character Kpa is a correction coefficient on the basis of an atmospheric pressure near the throttle inlet port (or throttle valve).

Character Kacc is a correction coefficient on the basis of a variation of the throttle opening degree.

In this way, the pulse-width (duty factor D) of the PWM signal is made larger with an increase in the fuel injection amount Ti×Ne, so that the fuel pump 14 can be driven at the maximum flow rate in the case where the pulse-width is maximized.

The pulse-width is made smaller with a decrease in fuel injection amount Ti, so that a current consumption of the fuel pump 14 can be reduced in the case where the fuel injection amount Ti is small.

To be more specific, the drive of the fuel pump 14 can be controlled such that a drive power of the fuel pump 14 is reduced when the fuel injection amount Ti is small, by controlling the drive of the fuel pump 14 on the basis of the control data of the fuel injection amount Ti of the fuel injector 16, that is, TiM, Ktw, Kta, Kpa, Kacc, and Ne and of the power supply voltage of the fuel pump 14.

FIG. 3 is a characteristic diagram showing characteristics of the correction amount Pv of the duty factor D depending on the power supply voltage of the fuel pump 14.

A table (data table) corresponding to the characteristic diagram shown in FIG. 3 is previously stored in the memory integrated with the ECU 19.

In this way, when the power supply voltage of the fuel pump 14 is more than a rating voltage Vo, a pulse-width of the PWM signal is reduced as compared to the case where the power supply voltage of the fuel pump 14 is equal to the rating voltage Vo, so that the drive power of the fuel pump 14 can be lowered and thereby the power consumption thereof can be reduced.

Similarly, when the power supply voltage of the fuel pump 14 is smaller than the rating voltage Vo, the pulse-width of the PWM signal is increased as compared to the case where the power supply voltage of the fuel pump 14 is equal to the rating voltage Vo, so that the fuel injection amount (or injection pressure) can be prevented from becoming deficient depending on a change in power supply voltage of the fuel pump 14.

In other words, the drive of the fuel pump 14 can be controlled such that the fuel injection amount is prevented from being varied depending on a change in power supply voltage of the fuel pump 14.

Figure 4:
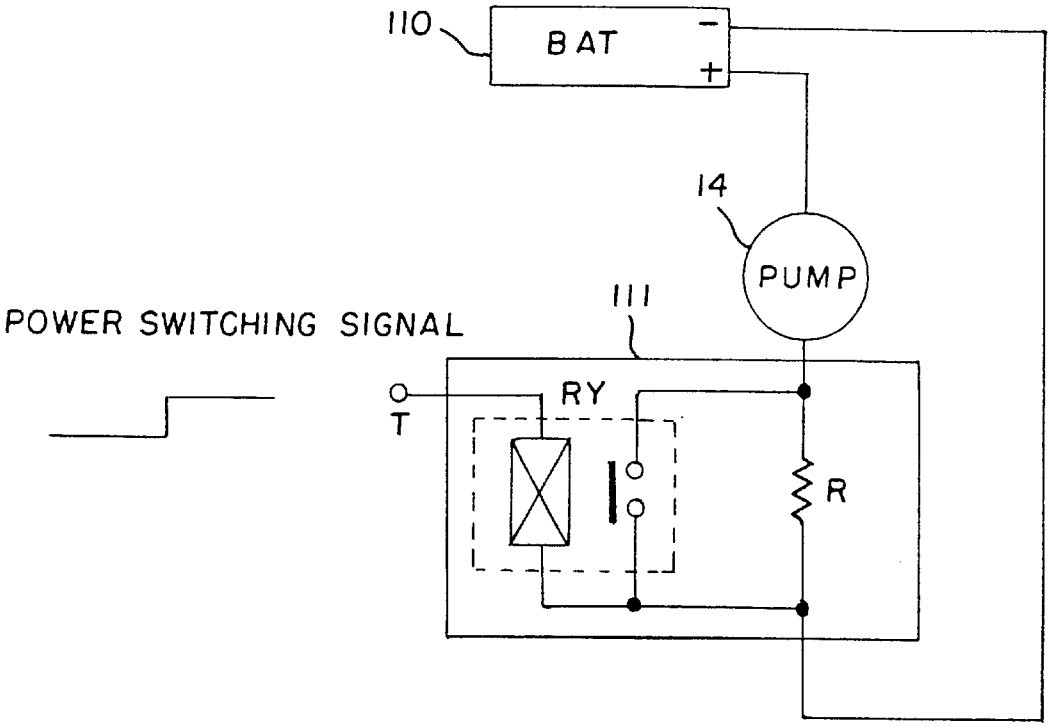
FIG. 4 is a schematic diagram illustrating one method of driving the fuel pump shown in FIG. 1.

As shown in FIG. 4, the switching means 111 shown in FIG. 1 may be formed of a relay RY and a resistor R.

Referring to FIG. 4, one contact of the relay RY is connected to an input terminal while the other contact of the relay RY is connected to an output terminal, and the resistor R is connected between the input and output terminals.

One end of a coil of the relay RY is connected to the control terminal T and the other end of the coil is connected to the output terminal.

During flow of current in the coil, both the contacts are connected to each other by a movable contact piece of the relay RY to be thus short-circuited.

Referring to FIG. 4, a power switching signal on the basis of a required fuel amount is supplied from the ECU 9 to the control terminal T.

Figure 5:
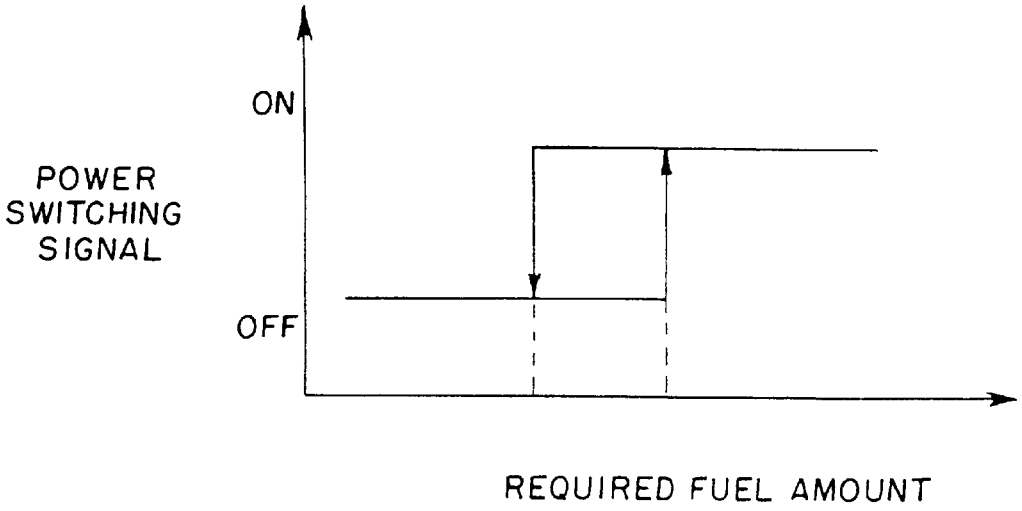
FIG. 5 is a characteristic diagram showing a power switching signal with respect to a required fuel amount.
Figure 6:
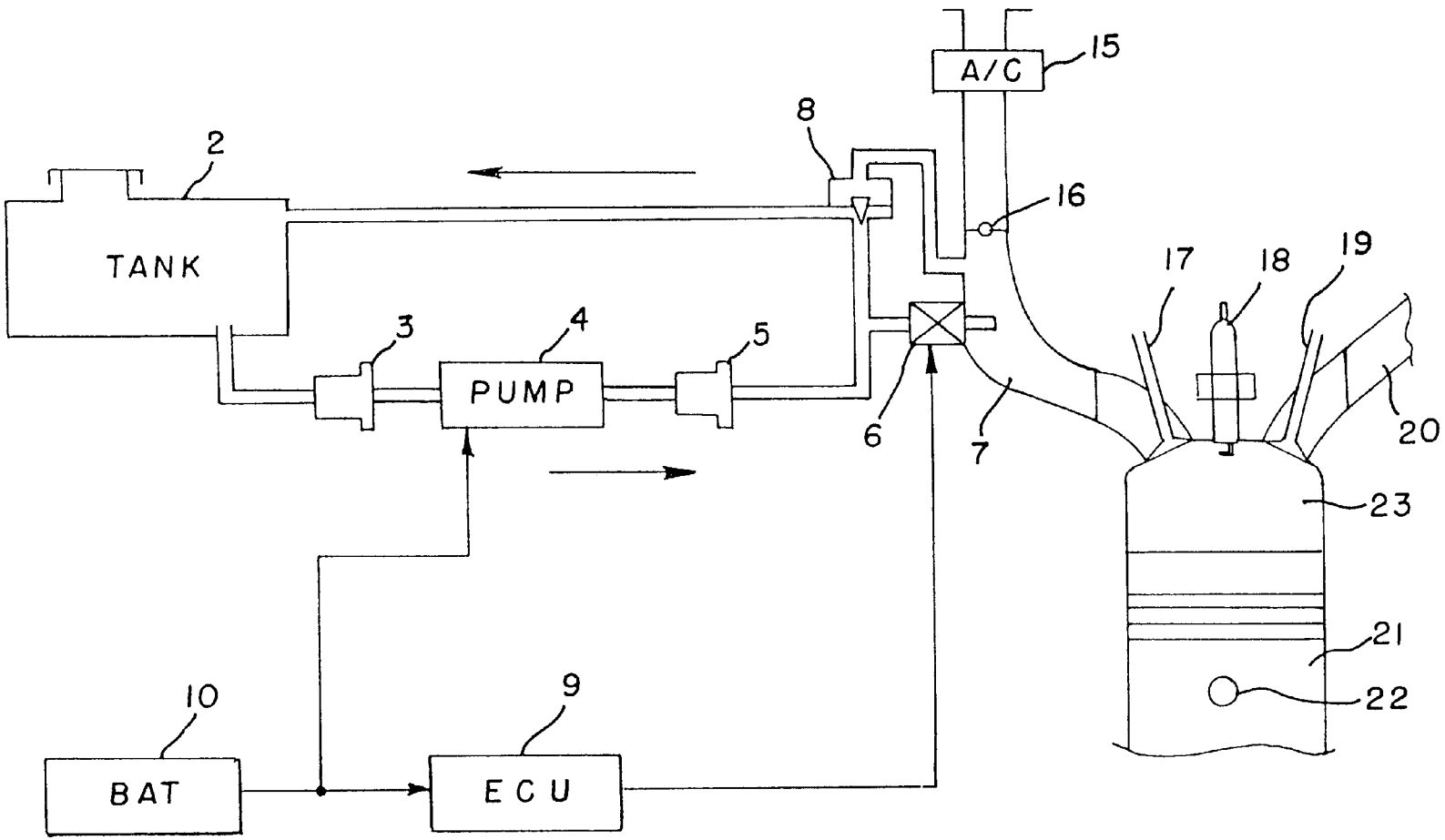
FIG. 6 is a conceptual diagram of a related art drive unit for driving a fuel pump of a motorcycle.

For example, a table (data table) indicating characteristics between the required fuel amount (fuel injection amount determined by calculation) and the power switching signal as shown in FIG. 5 is previously stored in the memory integrated with the ECU 19. The ON/OFF states (H/L levels) of the power switching signal correspond to the ON/OFF states of the relay RY.

The filter 13 shown in FIG. 1 may be disposed in the fuel tank 12 as a strainer, and the fuel injector 16 may include a solenoid valve.

An oxygen detecting sensor may be provided in an exhaust pipe or exhaust manifold for detecting a fuel injection amount from the exhaust gas and inputting the detection data in the control data.

The above-described embodiment of the present invention is for illustrative purposes only, and it is to be understood that the present invention is not limited thereto.

According to the drive unit for driving a fuel pump for a small-sized vehicle, since the drive of the fuel pump is controlled on the basis of the control data of the injection amount of the fuel injector and by the power supply voltage of the fuel pump, the drive of the fuel pump can be controlled such that the drive power of the fuel pump is reduced in the case where the fuel injection amount is small.

The drive of the fuel pump can also be controlled such that the fuel injection amount (or injection pressure) is prevented from becoming deficient depending on a change in power supply voltage of the fuel pump.

For example, the drive unit is configured such that a pulse-width of a PWM signal is made larger with an increase in the fuel injection amount of the fuel injector so that the fuel pump can be driven at the maximum flow rate when the pulse-width is maximized. Further, the pulse-width of the PWM signal is made smaller with a decrease in fuel injection amount of the fuel injector so that the power consumption of the fuel pump can be reduced when the fuel injection amount is small.

For example, when the power supply voltage of the fuel pump is larger than a rating voltage, the drive power of the fuel pump can be lowered and thereby the power consumption thereof can be reduced by reducing the pulse width of a PWM signal as compared to the case where the power supply voltage of the fuel pump is equal to the rating voltage.

When the power supply voltage of the fuel pump is smaller than the rating voltage, the fuel injection amount (or injection pressure) can be prevented from becoming deficient depending on a change in the power supply voltage of the fuel pump by increasing the pulse-width of the PWM signal as compared to the case where the power supply voltage of the fuel pump is equal to the rating voltage.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fuel injector control unit, comprising:

a memory unit wherein said memory unit includes control parameters for controlling performance of a fuel injector, the control parameters reducing a pulse-width of a PWM signal when a power supply voltage of the fuel injector is greater than a predetermined rating voltage, and the control parameters increase the pulse-width of the PWM signal when a power supply voltage of the fuel injector is less than a predetermined rating voltage.

2. The fuel injector control unit according to claim 1, wherein the power supply voltage is supplied by a vehicle battery.

3. The fuel injector control unit according to claim 1, wherein the PWM signal is supplied by the fuel injector control unit.

* * * * *